United States Patent [19]

Sloop et al.

[11] Patent Number: 4,766,941

[45] Date of Patent: Aug. 30, 1988

[54] WINDOW SHADE WITH SELECTIVELY VARIABLE SHADING CHARACTERISTICS

[75] Inventors: David J. Sloop; Hsiang-Lin Yu, both of St. Louis, Mo.

[73] Assignee: Sytron Corporation, University City, Mo.

[21] Appl. No.: 871,846

[22] Filed: Jun. 9, 1986

[51] Int. Cl.[4] ..... A47G 5/02

[52] U.S. Cl. ..... 160/241; 160/86; 160/310

[58] Field of Search ..... 160/241, 23 R, 24, 25, 160/120, 122, 85, 86, 310, DIG. 7, 90, 354, 368 R; 428/383; 52/202

[56] References Cited

U.S. PATENT DOCUMENTS

| | | | |
|---|---|---|---|
| 799,123 | 9/1905 | Weiser . | |
| 1,522,352 | 1/1925 | Wertheimer . | |
| 1,766,746 | 6/1930 | Heckman | 160/23 R |
| 1,830,405 | 11/1931 | Ohno . | |
| 1,878,710 | 9/1932 | Watson | 160/23 R |
| 2,271,099 | 1/1942 | Shur | 160/241 |
| 2,935,769 | 5/1960 | Lutes | 160/90 |
| 3,186,473 | 6/1965 | Myers et al. | 160/241 |
| 3,236,290 | 2/1966 | Lueder | 160/241 |
| 4,009,745 | 3/1977 | Erpenbeck | 160/297 |
| 4,042,028 | 8/1977 | Ennes et al. | 160/263 |
| 4,044,813 | 8/1977 | Emmons | 160/354 |
| 4,068,428 | 1/1978 | Peterson | 160/354 |
| 4,171,845 | 10/1979 | Hirsch | 160/310 |
| 4,172,563 | 10/1979 | Werner et al. | 242/55 |
| 4,258,517 | 3/1981 | Hammond | 52/202 |
| 4,290,473 | 9/1981 | Pierson et al. | 160/241 |
| 4,346,749 | 8/1982 | Singletary et al. | 160/301 |
| 4,347,886 | 9/1982 | von Knorring | 160/242 |
| 4,357,978 | 11/1982 | Keller et al. | 160/41 |
| 4,372,367 | 2/1983 | Baldanello et al. | 160/310 |
| 4,382,436 | 5/1983 | Hager | 160/241 |
| 4,610,292 | 9/1986 | Hausmann et al. | 160/241 |

*Primary Examiner*—Ramon S. Britts
*Assistant Examiner*—Blair Johnson
*Attorney, Agent, or Firm*—Polster, Polster and Lucchesi

[57] ABSTRACT

An electrically powered window shade with selectively variable shading characteristics is installable within a window opening for selectively blocking (by absorption or reflection), filtering and/or transmitting light through the window shade into a room for purposes of energy control and/or decoration, etc. This window shade comprises an upper roller assembly, a lower roller assembly, and an elongate flexible web wound on the upper and lower roller assemblies, with the web being longer than the spacing between the upper and lower roller assemblies. Each of the roller assemblies comprises an elongate tubular roller, bearings engageable with the end of the roller for rotatably journaling the ends of the roller with respect to the window. The web is scrolled onto and from the rollers as the latter are rotated about their respective longitudinal axes. A drive is provided for each of the rollers so as to drive the rollers in one direction or the other so as to scroll the web from one of the rollers onto the other roller. The drive comprises a gearmotor having an output shaft substantially coaxial with the gearmotor, and with the gearmotor being received within the roller, with the output shaft being coaxial with the roller. The gear motor is fixed against rotation with respect to the frame. Further, each of the gearmotors includes a torsional spring for maintaining the web taut as it is scrolled and unscrolled from one roller to the other, and while the web is stationary and to accommodate changes in rotation rates and roll diameters as the web is scrolled and unscrolled. Specifically, this torsional spring operatively connects the output shaft of each gearmotor with its respective roller. The torsional spring of one of the rollers is wound in one direction (e.g., clockwise), and the other torsional spring associated with the other gearmotor is wound in the other direction (e.g., counterclockwise) so that upon initial energization of one gearmotor or the other, differences in rotational speed and start-up times between the gearmotors will be taken up.

9 Claims, 3 Drawing Sheets

WINDOW SHADE WITH SELECTIVELY VARIABLE SHADING CHARACTERISTICS

BACKGROUND OF THE INVENTION

This invention relates to a window shade, and more particularly to a power-operated window shade having rollers at the top and bottom of the window with a flexible film attached to the upper and lower rollers, with the film having selected coatings thereon for varying the reflectivity, transmissivity, or other characteristics of the shade thereby to regulate the amount of light and solar radiation admitted into the room via the window opening, and also to provide privacy and ventilation, as desired, by the occupants of the room.

Generally stated, the window shade of the present invention utilizes an upper and a lower roller assembly, each powered by an electric motor, with the upper and lower rollers having an elongate flexible film of synthetic resin or the like, such as a suitable polyester resin, having a variety of segments thereon, with each segment coated so as to reflect or transmit light either from an outside source (e.g., solar radiation) or from an inside source (e.g., a lamp).

Reference may be made to U.S. Pat. No. 799,123, which discloses a double pane window having a roller shade disposed at the top thereof with the shade extending downwardly between the inner and outer window panes.

U.S. Pat. No. 1,522,352 discloses a structure for a security shutter in which the shutter is furled and unfurled from a roll at the bottom and has a chain and counterweight arrangement for biasing the shutter upwardly. A drive assembly is provided at the end of the roller for furling and unfurling the shutter assembly.

U.S. Pat. No. 1,830,405 discloses a shutter assembly having a winch and cable drive mechanism for opening and closing the shutter.

U.S. Pat. No. 3,186,473 discloses means for controlling the light entering the room comprising a pair of rollers, one at the top of the window and one at the bottom of the window, with an elongate sheet of plastic having a number of panels therein of generally equal length, with the length of each of the panels being somewhat greater than the distance between cross strips at the top and bottom of the window. An electric motor powers the bottom roller, and a hand-operated crank is provided for the upper roller. The rectangular panels may have pictorial scenes printed thereon, and others of the panel may either be transparent or have some light-reducing color or filter media thereon for reducing the amount of light entering the window.

U.S. Pat. Nos. 4,009,745 and 4,042,028 disclose various tube shade rollers having spring return drives.

U.S. Pat. No. 4,172,563 discloses a drive for an awning or roller drive in which a tubular shaft is driven, and upon which is supported a shade to be wound and unwound. The roller is driven by a planetary gear drive located within the shaft or roller.

U.S. Pat. No. 4,346,749 discloses a motor support for a window shade. A spring motor is utilized to wind and unwind the window shade.

U.S. Pat. No. 4,347,886 discloses a roller blind in which a reversible motor drives a roller via a worm gear and sector drive mechanism.

U.S. Pat. No. 4,357,978 discloses a seal system for the edges of a window shade and a seal for the lower edge of the window shade when it is in its lowered position.

U.S. Pat. No. 4,372,367 discloses a roller blind having a reversible electric motor located coaxially with respect to the roller tube.

With the advent of modern curtain wall buildings and contemporary residences having large expanses of window area, it is important to control the amount of solar radiation entering the building through the windows such that in the summertime, air conditioning loads are minimized, and such that during the wintertime, solar radiation may be utilized, as much as possible, to assist in heating the building. Oftentimes, buildings of contemporary architecture utilize a mirrored, reflective glass window so as to minimize transmission of solar radiation into the building, thereby to minimize solar heat loads during the summer months, and thus minimizing air conditioning requirements. While these reflective, mirrored windows work well for minimizing solar radiation heat loads for air conditioning applications, they effectively prevent any solar radiation in heating of the building (even to a limited extent) during the wintertime. Also, with such permanently installed glazed windows, the occupants of the building could not selectively permit additional sunlight to enter the building, or could not ensure total privacy without the addition of interior shades or drapes.

As certain of the above-identified prior art patents have disclosed, it may be advantageous to provide a power-operated window shade arrangement having a variety of different segments on the shade, with each segment having its own reflective characteristics thereby to selectively control the amount of radiaton or light entering or exiting a room thereby to control solar radiation heating effects within the room, and so as to ensure privacy. It has also been recognized that by automatically controlling operation of the window, as by computer control system or the like, the solar heating loads on the building, both during the summer and winter months, can be advantageously controlled so as to minimize air conditioning heat loads, and so as to maximize solar radiation heating during the winter months.

However, there has been a long-standing problem with all such power-operated windows as to how one could effectively and automatically scroll and unscroll the window shade material from the upper and lower rolls in such manner that a wide variety of window lengths can be accommodated, and yet so that under all various conditions, the window shading material would remain taut and free of wrinkles or creases so as to remain substantially imperceptible to the occupants within the building, and so as to create a uniform architectural appearance from the exterior of the building.

SUMMARY OF THE INVENTION

Among the several objects and features of the present invention may be noted the provision of a powered window shade with selectively variable shading characteristics which maintains the window shade material taut regardless of the spacing between the upper and lower rollers, and regardless of how much of the shading material is scrolled onto or from the upper and lower roller assemblies;

The provision of such a window shade which maintains the window shade material under a desired degree of tension during start-up of powered operation of the window, during steady state powered operation of the window, and upon termination of the powered operation of the window;

The provision of such a window shade which is effectively sealed relative to the window along its sides and along its top and bottom thereby to at least partially act to insulate the windows against undue heat loss or gain;

The provision of such a window shade which utilizes rollers of relatively small diameter so as to be as unobtrusive as possible on the inside of the window and in which the drive mechanism is located coaxially within the rollers such that the window shade takes up a minimum amount of space at the top and bottom of the window frame;

The provision of such a window shade which can use electrostatic charge as a means of securing a scrolled optically coated polyester film to a thicker transparent plate to obtain mechanical rigidity and lateral stability for the optically active surface;

The provision of such a window shade which can use optical and/or magnetic strips combined with a reader and decoder to sequentially and accurately register any one of many optically coated film segments in any order for the desired time periods; and The provision of such a window shade which may be readily used with a large variety of old and new windows of various sizes, which is reliable in operation, and which has a long service life.

Other objects and features of this invention will be in part apparent and in part pointed out hereinafter.

Briefly stated, a window shade of the present invention is installable within a window opening for selectively at least partially blocking, filtering, and transmitting light therethrough. The window shade comprises an upper roller assembly, a lower roller assembly, and an elongate flexible web substantially longer than the spacing between the upper and lower roller assemblies. Each of the roller assemblies comprises an elongate tubular roller, bearing means engageable with the ends of each of the rollers for rotatably journaling the ends of the roller with respect to the window frame. The web is scrolled onto and from the rollers as the rollers are rotated about their respective longitudinal axes. Means is provided for selectively driving each of the rollers in one direction or the other so as to scroll the web from one roller onto the other of the rollers and vice-versa. The driving means comprises a gearmotor having an output shaft substantially coaxial with the gearmotor. The gearmotor is received within the roller, with the output shaft being substantially coaxial with respect to the longitudinal axis of the roller. The gearmotor is fixed against rotation with respect to the frame. Means is provided for maintaining the web taut as the web is scrolled and unscrolled from one roller to the other, and while the web is stationary. This last-mentioned means comprising a torsional spring operatively connecting the output shaft of each said gear motor and its respective roller, with the torsional spring of one of the rollers being wound in one direction (e.g., clockwise), and with the torsional spring of the other gear motor being wound in the opposite direction (e.g., counterclockwise).

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
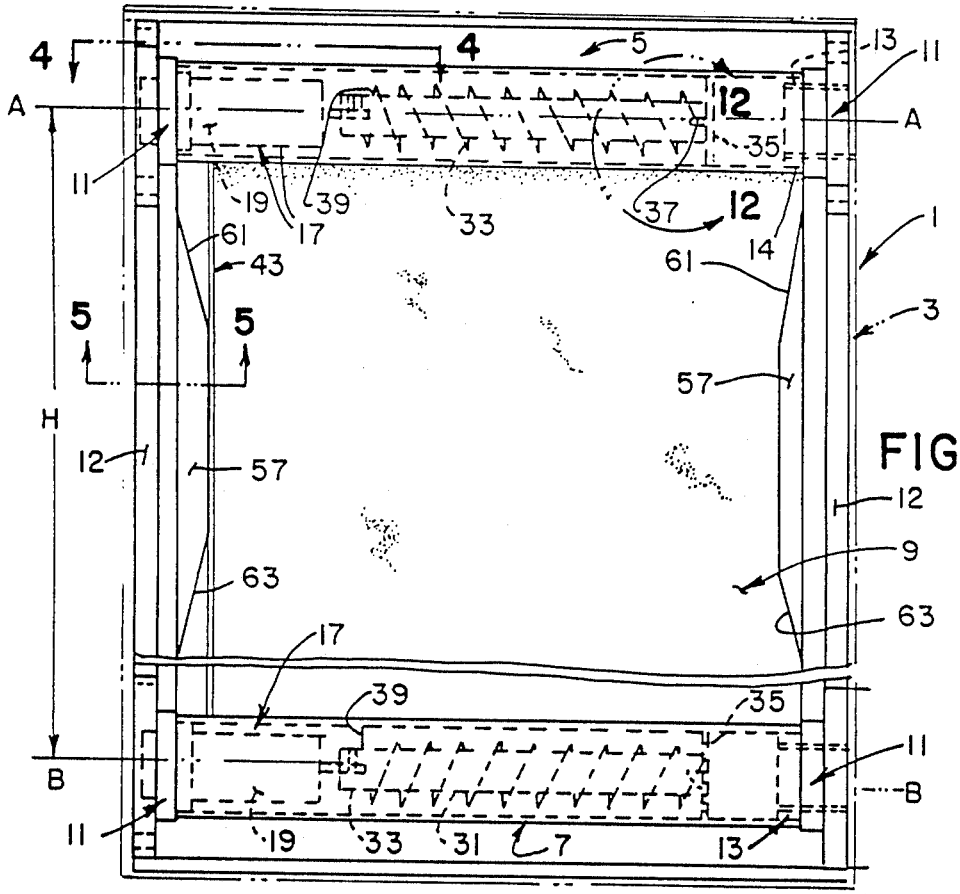
FIG. 1 is a front elevational view of a window opening illustrating a powered window shade of the present invention including an upper roller assembly, a lower roller assembly, and an elongate shade of plastic film rolled onto the upper and lower roller assemblies.
Figure 5:
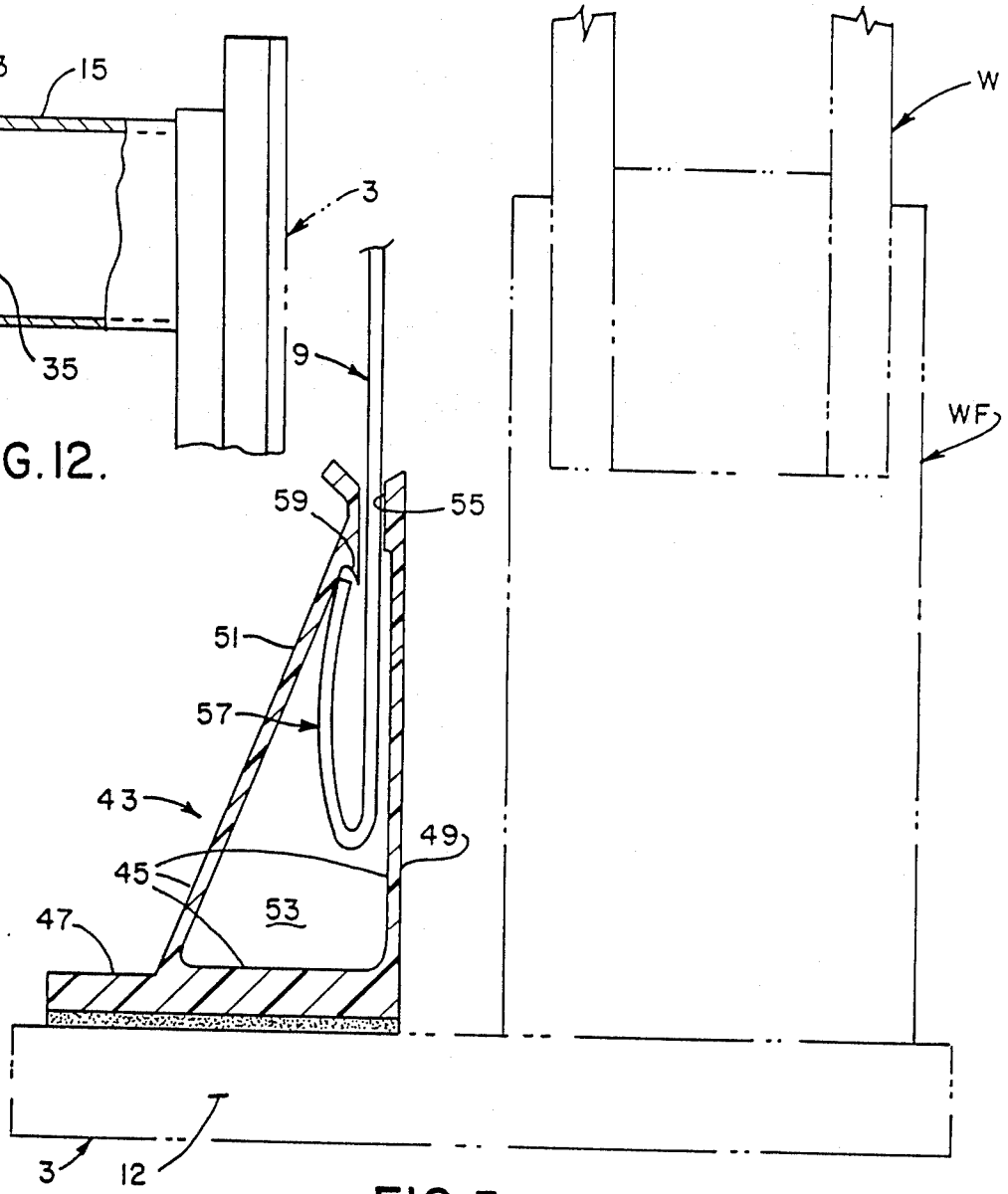
FIG. 5 is a cross sectional view, in greatly enlarged scale, taken along line 5—5 of FIG. 1.

Referring now to the drawings, a powered window shade apparatus, in accordance with this invention, is generally indicated by reference character 1 and is shown to be installed in an existing window opening 3 (as shown in phantom in FIG. 1). Window shade assembly 1 includes an upper roller assembly 5, a lower roller assembly 7, with the upper and lower roller assemblies extending generally horizontally between the sides of window opening 3 with the longitudinal axes of the upper and lower roller assembly being generally parallel to one another. The window shade assembly 1 further includes an elongate film or web, as generally indicated at 9, and as is shown in its extending length in FIG. 6. Shade web 9 is preferably of a limp synthetic resin or plastic film (e.g., polyester) having a plurality of segments S1–S5, with each of the segments having a length L somewhat greater than the height H (as shown on FIG. 1) which is the vertical distance between the longitudinal axes of the upper and lower roller assemblies 5 and 7, respectively. Each of the film segments S1–S5 may be coated or otherwise treated (or non-treated) with a suitable coating so as to vary the reflectivity and the transmissivity of the shade film so as to pass or block a desired amount of solar radiation or light. For example, segment S1 may be transparent so as to transmit substantially all solar radiation into the building, and so that occupants within the building would have an unobstructed view through the shade web 9 to the exterior of the building. Segment S2 may have a reflective coating thereon so as to reflect a substantial portion (e.g., 50 percent) of the solar radiation impinging upon shade 9 when segment S2 is in register with the window opening between the upper and lower roller assemblies 5 and 7, respectively. Segment S3 may be a substantially opaque coating so as to totally block solar radiation from passing through the window opening and also to prevent persons outside the building from viewing into the building, thus assuring privacy. Segment S4 is shown to have a picture area P located thereon so that a decorative or artistic scene may be scrolled into place within the window opening of the building so as to serve as an interior decorating accessory within the building and/or optionally an exterior decoration that can be viewed from outside the building. Further, segment S5 is shown to have an opening O therethrough, such that when the opening is in register with the window opening, the side portions of the web 9 still interconnect the web into the upper and lower roller assemblies 5 and 7, but yet the opening O is in register with the window opening 3, such that if the glass window panes W (as shown in FIG. 5) are capable of being open to the exterior, ventilating air may pass through window shade film 9. Additionally, opening O permits escape from the building in case of fire and facilitates cleaning of the window. It will be understood that, within the broader aspects of this invention, web 9 may be of any desired length and may have an almost limitless number of segments thereon, each having various coatings, colorings, pictures, or other indicia for a variety of purposes.

More specifically, it is believed that a clear polyester film can be used as a substrate for web 9 so as to provide adequate structural strength and dimensional stability. It has been found that a thickness of 4 mils for the polyester film substrate works well. Additionally, the web substrate may be laminated with a 0.5 mil thickness film having a desired transmissivity or reflectivity property to obtain the desired optical characteristics for each segment shown in FIG. 6 and providing mechanical strength and protection for the relatively thin optical coating(s).

Figure 4:
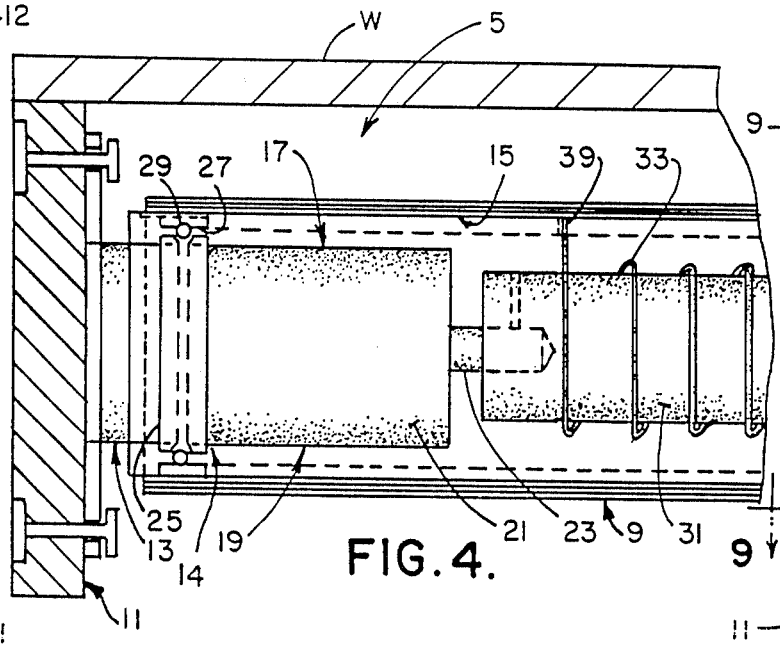
FIG. 4 a view taken along line 4—4 of FIG. 1, illustrating, in enlarged scale, one end of a roller assembly shown in cross section, illustrating a planetary gearmotor located coaxially within the roller for driving a spring connected to the roller, and further illustrating means for maintaining the shade web taut between the upper and lower rollers.

Referring now to FIGS. 1 and 4, it will be seen that the outer ends of upper roller assembly 5 and lower roller assembly 7 are each supported by a respective end bearing and anchor block, as generally indicated at 11, so as to secure the upper and lower roller assemblies within window opening 3. Side frames 12 extend between the end bearing and anchor blocks 11 of the upper and lower roller assemblies along the inside surfaces of window opening 3. Each end bearing and anchor block 11 includes an inwardly protruding hub 13. Hub 13 is utilized to receive and center the outer end (i.e., the end of roller assembly 5 or 7 opposite its drive motor, as will be hereinafter specified). A suitable anti-friction bearing 14 is interposed between hub 13 and the inner surface of the upper and lower roller assemblies for journaling one end of the roller assembly relative to a respective end bearing and anchor block 11.

Each roller assembly 5 (or 7 if spring is changed to opposite sense) is shown, in FIG. 4, to include an elongate tubular roller 15. Located coaxially within roller 15 is a powered drive assembly, as generally indicated at 17, for scrolling and unscrolling shade film web 9 onto and from a respective roller assembly 5 and 7, and for maintaining the shade film web 9 under a desired degree of tension thereby to maintain the shade film taut while the shade film is being scrolled and unscrolled relative to the roller assemblies and while the shade film is stationary. More specifically, powered drive means 17 comprises an electric gearmotor 19 including a planetary gear reduction drive, also part of 19, as well as output shaft 23, drive shaft 31, and spring 33. Gearmotor 19 includes an outer cylindrical housing 21 having its outer end (i.e., its left end, as shown in FIG. 4) fixedly secured with respect to its respective end bearing and anchor block 11. The gearmotor further comprises an output shaft extending out beyond the inner end of the gearmotor (i.e., on the the end of housing 21 opposite end bearing and anchor block 11) such that the output shaft 23 is substantially coaxial with respect to the longitudinal axis of its respective roller 15. While gearmotors having a wide variety of gear reductions may be suitable within the broader aspects of this invention, it is preferable (but not required) that the gear reduction ratio of gearmotor 19 be approximately 1000 to 1. In this manner, gearmotor friction and mechanical advantage of the speed-reducing gear set brakes the drive system when both gearmotors 19 for the upper and lower roller assemblies 5 and 7, respectively, are de-energized, such that the shade film 9 is held under constant tension in a manner as will hereinafter be described in detail.

Anti-friction bearing 14 will now be described in detail.

As indicated at 25 in FIG. 4, an inner bearing race is provided on the outer surface of motor housing 21 proximate end bearing and anchor block 11. Another bearing race 27 is provided on the inner face of roller 15 so as to surround inner bearing race 25 and a plurality of roller bearing elements 29 is interposed between the inner and outer bearing races 25 and 27 so as to journal one end of roller 15 with respect to the fixed cylindrical housing 21 of gearmotor 19.

The drive system for the upper and lower roller assemblies 5 and 7 further comprises a drive shaft 31 positively coupled to and substantially coaxial with gearmotor output shaft 23. Drive shaft 31 extends coaxially within roller 15 from output shaft 23 of gearmotor 19 along a substantial distance or portion of the length of roller 15, substantially as shown in FIG. 1. A helical coil torsion drive spring 33 surrounds drive shaft 31. The outer end of drive shaft 31 is supported by a circular bushing 35 which frictionally slides on the inner surface of roller 15, with circular slide bushing 35 serving to maintain drive shaft 31 substantially centered with respect to its roller 15. One end of torsion drive spring 33 is fixedly secured in a slot in the end of drive shaft 31, as indicated at 37. The other end of the torsion drive spring is fixedly secured to roller 15, as indicated at 39.

In accordance with this invention, it will be noted that torsion drive spring 33 for the upper roller assembly 5 has convolutions which are wound in one direction (i.e., clockwise, when viewed looking toward drive motor 19), while the other torsion drive spring 33 associated with the lower roller assembly 7 is wound in the opposite direction (i.e., counterclockwise, when viewed looking toward its respective gearmotor 19). In this manner, the two drive springs 33 for the upper and lower roller assemblies store a substantial amount of mechanical energy upon energization of their respective motors 19, such that the motors are operated in opposite directions so as to resiliently pre-load the springs in opposition to one another in such manner that a desired torque is applied to the motors and such that a predetermined amount of tension is applied to web 9 stretched taut between roller assemblies 5 and 7. In this manner, the springs compensate for differences in rotation rates between the upper and lower rollers, due both to differences in operational speed of the gearmotors, and due to the fact that different thicknesses of shade film 9 may be wound onto the upper or lower roller assemblies such that upon energization of their motors, the surface speed at which the shade web is wound or unwound from each roller may vary, even though the rotational speed (in rpms) of the upper and lower rollers is substantially identical. It will also be understood that the provision of slide bushing 35 on the outer end of drive shaft 31 permits the roller 15 to freely rotate with respect to the drive shaft.

Alternatively, it should be noted that the torsional springs can be wound in the same sense if the gearmotors are mounted in opposite ends of the rollers. This latter configuration may have possible advantages in allowing mass production of identical parts for both top and bottom rollers.

Figure 2:
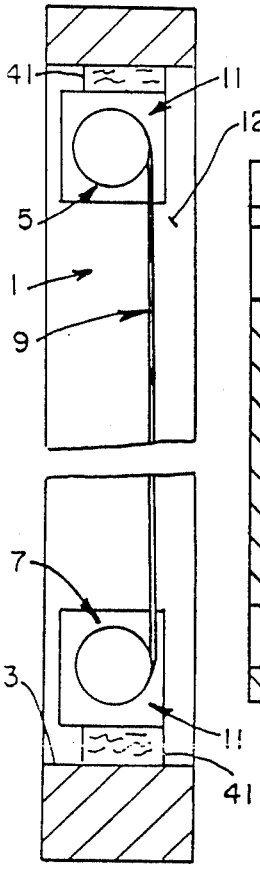
FIG. 2 is a right side elevational view of FIG. 1, illustrating a first embodiment of the powered shade of the present invention.
Figure 6:
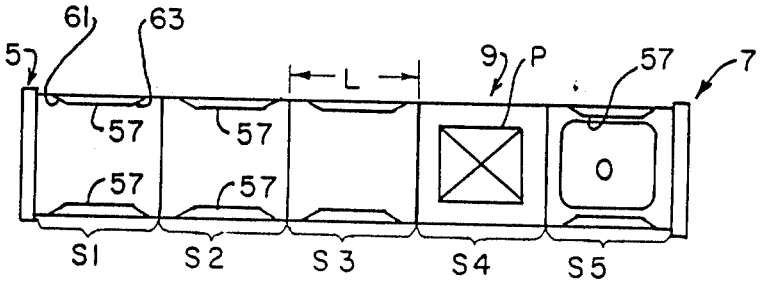
FIG. 6 is a flat pattern layout of the shade material, illustrating a number of segments having a height or length greater than the spacing between the upper and lower rollers, with each of the segments having a desired reflective or transmissive coating thereon for varying the amount of light transmitted through or blocked by the shade of the present invention.

As those skilled in the art will recognize, operation of powered shade is controlled by energizing and de-energizing gearmotors 19 of upper and lower roller assemblies 5 and 7. Preferably these gearmotors are reversible so that they may be rotatably driven in either clockwise or counterclockwise direction. To move shade 9 upwardly, gearmotor 21 for upper roller assembly 5 is operated in one direction (clockwise, as shown in FIG. 2) so as to wind up (i.e., scroll) an additional amount of web 9 onto the upper roller. Simultaneously, gearmotor 19 for the lower roller assembly is operated in the same direction (i.e., clockwise, as viewed in FIG. 2) so as to unwind (i.e., to unscroll) web 9 from the lower roller. As heretofore described, with springs 33 wound in opposite directions, and with the drive shaft rotated a number of full and/or partial revolutions to induce a predetermined torque level on springs 33, web 9 will remain taut as it is scrolled and unscrolled along the full length of the web, as shown in FIG. 6, and while it is stationary. Energization of the gearmotors 19 is preferably accomplished by solid state or relay logic (not shown) to automatically apply voltages with the proper magnitude and polarization upon an "up" or "down" command which can be applied by manually operated switches, or by a computer (not shown) so as to automatically control the effects of solar radiation on heating and air conditioning.

Figure 8:
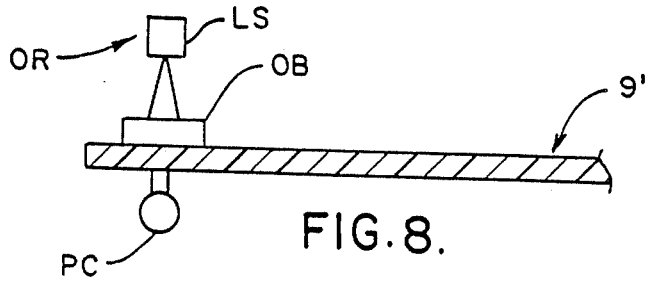
FIG 8 is an enlarged cross sectional view taken along line 8—8 of FIG. 7 showing an optical reader for determing in which web segment is in register with the window opening.

An optical reader OR (as shown in FIG. 8) along an edge of the scrolling mechanism responds to alternate reflective and absorptive optical bands OB that are provided on the various shade segments S1'–S5' to detect the presence of a particular shade segment in register with the window opening and the proper registration of that shade segment in the opening.

The polyester film that is used in the preferred embodiment of this invention is dimensionally stable under normal room temperature and humidity conditions. This type of film is also commonly used as a substrate for audio and video tapes as well as camera films. Information can be encoded magnetically or optically on properly coated optical bands OB of the shade segments and this information can be serially read from the film by optical reader OR or a suitable magnetic flux detector as the film is scrolled from one roll onto the other.

In one embodiment of this invention (FIG. 8), optical reader OR for sensing optical bands OB and for controlling scrolling and unscrolling of rolls 5 and 7 in response thereto comprises a light source LS and photocell PC mounted along one edge of the window shade assembly detects alternately reflective and absorptive optic bands OB that have been placed along the edges of the various shade segments shown in FIG. 6. Each band OB contains encoded information about the type of optical coating that is present on the marked shade segment and the position of the band OB can be used to accurately register a given shade segment S1'–S5' in the window opening. It will be appreciated that control signals generated by optical reader OR in response to optical bands OB may be used to selectively energize and de-energize motors 17 in the manner heretofore described to scroll and unscroll the web 9 by using suitable logic circuitry and/or microprocessor and electronic driving circuits that are apparent to those skilled in the art.

Figure 3:
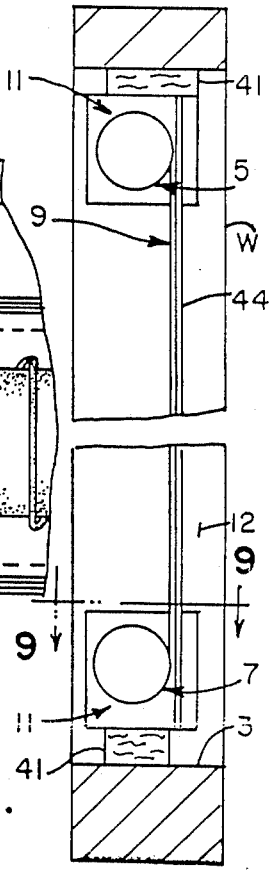
FIG. 3 is a view similar to FIG. 2 illustrating a second embodiment of t present invention.
Figure 12:
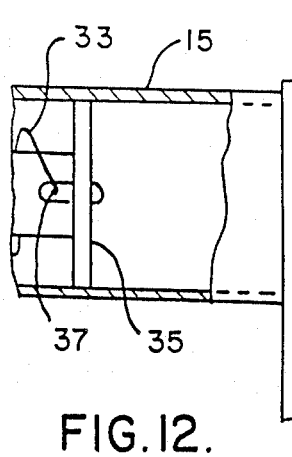
FIG. 12 is an enlarged view of the roller, taken along line 12—12 of FIG. 1, illustrating a circular bushing supporting the end of a shaft within the roller.

As best shown in FIGS. 2 and 3, vapor seals 41 may be provided at the top and bottom of the window shade assembly 1 of the present invention so as to effectively seal the window shade assembly 1 relative to window opening 3 at the top and bottoms of the window shade assembly.

Additionally, optional means, as indicated generally at 43 in FIG. 5, may be provided for guiding and sealing the edges of shade film web 9 relative to the sides of the window openings. This guiding and sealing means 43 serves to positively hold the lateral edges of the shade film web 9 in fixed position relative to the window opening, and also serves to prevent interior air from circulating so as to freely be in thermal conduction contact with window panes W (see FIG. 5) of the window opening 3. In this manner, the shade film web 9 of the window shade assembly 1 of the present invention, serves as an auxiliary window pane to further aid in thermally insulating the window opening thereby to increase the "R factor" of the window opening provided with the window shade assembly 1 of the present invention. As shown in FIG. 3, an additional transparent rigid sheet 44 of synthetic resin material (e.g., acrylic resin) may be disposed on the outer surface of shade web 9 between the shade web and window pane W. This clear plate 44 provides additional mechanical rigidity for the limp shade film web 9 stretched between the upper and lower roller assemblies and protects any fragile coating that may be applied to the shade film web 9. Additionally, this clear rigid sheet 44 serves as an additional glazing sheet which even further enhances the thermal insulating capabilities of the window shade assembly 1 of the present invention.

When a clear plate 44 (FIG. 9) is used, the scrolling mechanism (i.e., motors 17) is used to move only the thin optically coated polyester film 9 since mechanical rigidity is obtained by electrostatically bonding the unscrolled registered thin coated film segment to the clear plate. Because of the reduced thickness of the scrolled material, more shade film segments can be accommodated by a scrolling mechanism of a given diameter. An electrostatic charge is generated naturally when certain coated polyester materials are moved against one another and against clear plate 44 by the scrolling mechanism. In many cases it appears that this charge provides sufficient bonding between the clear polyester plate 44 and the scrolled thin film to adhere the thin film to the surface of the transparent plate. However, in other cases it may be necessary to spray an additional charge on the surfaces to achieve the desired bonding strength and maintain the bond for many hours.

Figure 7:
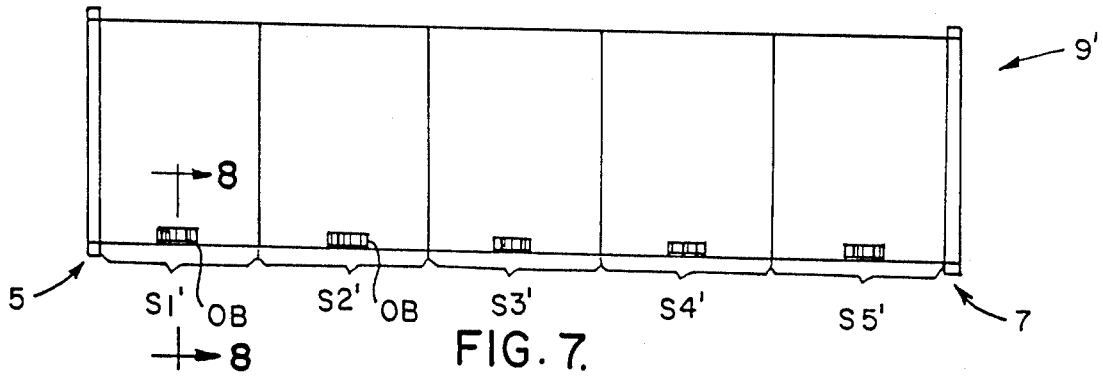
FIG. 7 is a view similar to FIG. 6.

Further, it should be noted that when a clear plate 44 is used, quick access to the original window for air circulation, cleaning, and emergency escape is made possible by making the plate and scrolling mechanism a single assembly that can be quickly and easily moved out of the way. A flexible gasket PG between the window frame and the scrolling mechanism is used to frictionally hold the scrolling mechanism in place. The shade material segments used with the clear plate are shown in FIG. 7. A clear segment and many variously coated segments are shown. However, unlike the web shown in FIG. 6, there is no segment with a cut-out for window access. Also note that the folds in the film material 57 are not necessary, nor the means for sealing the guiding edges of the scrolled film 43 in FIG. 5, because the electrostatic bonding between the clear plate 44 and the thin film provides the required mechanical strength and lateral stability.

As shown in FIG. 5, means 43 for guiding and sealing the edges of shade film web 9 is shown to comprise a side member 45 of extruded plastic or the like bonded to each window side frame member 12. Each of the side members 45 includes a base 47 which is adapted to be adhesively bonded to a respective side frame 12. An inner arm 49 extends inwardly of the window opening proximate window pane W from base 47 and an outer arm 51 extends inwardly from the base with the outer arm 51 being inclined with respect to the plane of shade film web 9 such that a central opening or cavity 53 is provided within extruded side member 45. A gap 55 is provided between the outer ends of the inner and outer arms 49 and 51, respectively. The width of gap 55 is such that the gap is only slightly larger than the thickness of shade film web 9, but yet so the web may be readily moved relative to the extruded side members without substantial frictional drag of the outer ends of the inner and outer arms 49 and 51 on the film web. In this manner, the outer margins of the film web 9 between the upper and lower roller assemblies 5 and 7, respectively, are effectively sealed with respect to the window opening.

Further in accordance with this invention, in order to maintain shade film web 9 centered on the upper and lower roller assemblies 5 and 7 between side frame members 12 as the shade film web is scrolled and unscrolled from its respective rollers, means, as generally indicated at 43, for guiding and sealing the edges of film 9 is provided on the outer margins of the shade film web 9 so as to be engageable with guiding and sealing means 43 thereby to maintain the shade film web 9 substantially centered with respect to side frame members 12. As indicated at 43, this last said means comprises a fold formed at intervals along the length of film web 9. As shown in FIG. 5, film fold 57 is constituted by folding the film back on itself at intervals therealong (as shown in FIG. 6), the edge of the film fold is engageable with a hook 59 formed on the inner face of outer arm 51 of extruded side member 45 thereby to prevent movement of the film web 9 out of opening 53 within extruded side member 45. Of course, with a similar fold on the opposite side of web 9, the web is positively prevented from shifting laterally in the plane of the web by the pair of extruded side members 45 carried by side frames 12.

As shown in FIGS. 1 and 6, film folds 57 are provided at spaced intervals along the entire length of web 9. As shown in FIGS. 1 and 6, only one such film fold 57 is provided in each segment S1–S5 of the film web. Each film fold 57 is provided with a leading edge 61 and a trailing edge 63 so as to provide a transition between the outer margins of the film web proximate base 47 of extruded side members 45 in the regions of the web 9 devoid of film folds 57. It will be appreciated by providing film folds 57 only at spaced intervals along the outer margins of web 9 that the additional build-up of the web material on the rollers as the web is scrolled and unscrolled from the rollers is maintained at a minimum. Those skilled in the art will recognize that, within the broader aspects of this invention, the number of film folds 57 provided on shade film web 9, the length of the film folds may be varied considerably and still be within the broader aspects of this invention.

Figure 9:
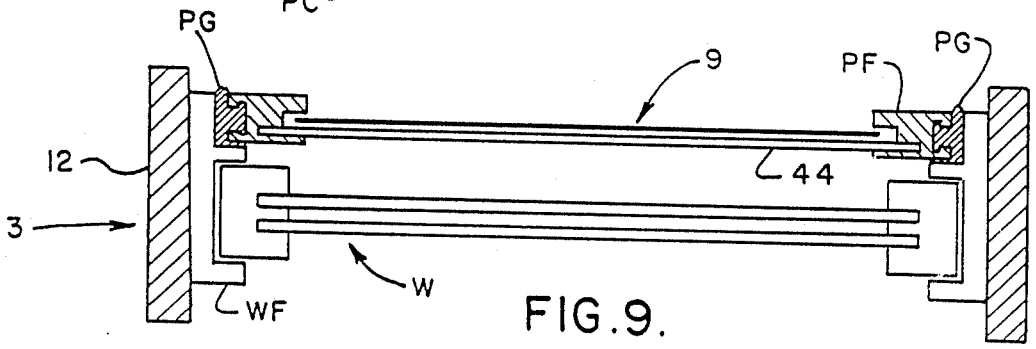
FIGS. 9–11 are views similar to FIG. 5, showing another embodiment of this invention.
Figure 10:
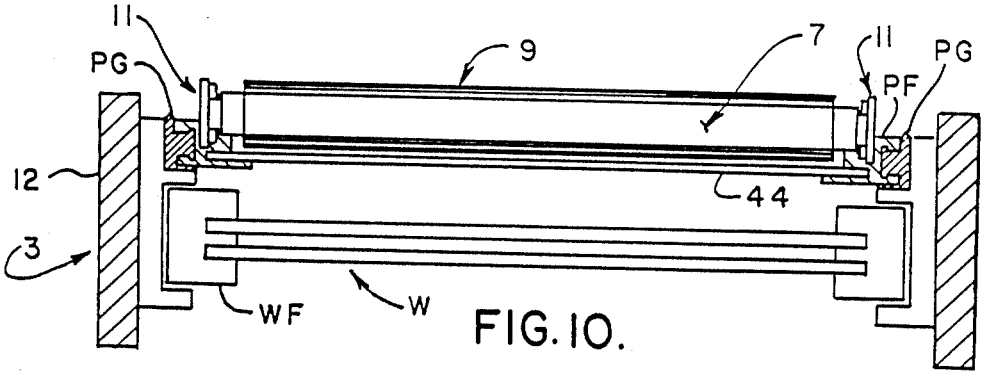
Figure 11:
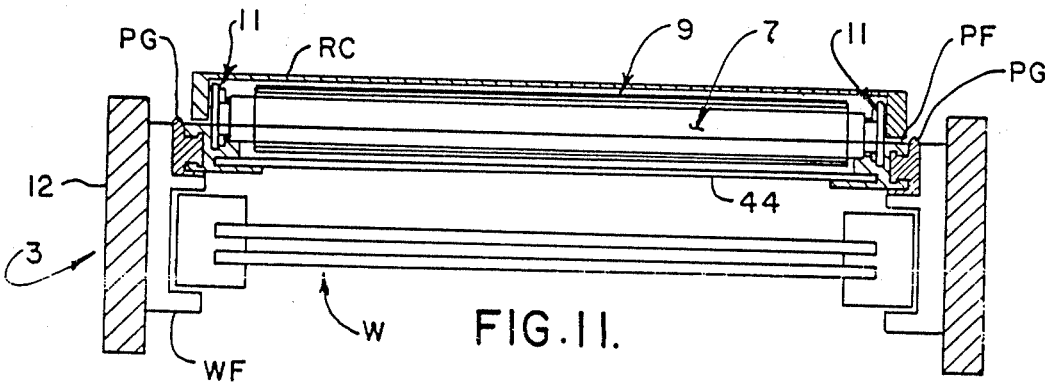

Referring now to FIGS. 9–11, FIG. 9 is a cross sectional view, taken along line 9—9 of FIG. 3, illustrating, in cross section, a double paned window W movably mounted in a window frame WF in a window opening 3. On the inside of the window, a rigid clear sheet 44 of polyester material or the like extends both transversely and vertically of the window opening, and is held in position relative to the window opening by means of a pane frame PF, with the pane frame being adhesively or frictionally, sealably secured to window frame WF by a suitable gasket PG. On the inside of the rigid polyester sheet 44, the scrolled shade web 9 is disposed as it is scrolled and unscrolled from roller assemblies 7 and 5, as shown in FIG. 3. The bearing blocks 11 are carried by the pane frame PF, and an optional roller cover RC, as shown in FIG. 11, may be snapped into place over roller assemblies 5 and 7 on the inside of the window opening.

For instance, in the mass production of this device some obvious changes in the configuration shown here would be beneficial in reducing manufacturing costs. For example, the springs 33 shown in FIG. 1 are different for the upper roller assembly 5 and the lower roller assembly 7 (one is wound clockwise and the other one is wound counterclockwise) in order to obtain the desired constant tension on the scrolled web 9. The top and bottom springs 33 can be identical if the bottom gearmotor 19, shaft 31, bottom spring 33, and bearing assemblies are mounted in the opposite end of the lower roller 15 with respect to the unchanged top roller assembly 5 shown in FIG. 1.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. Apparatus installable within a window opening for selectively at least partially absorbing, reflecting, and transmitting light, said apparatus comprising an upper roller assembly, a lower roller assembly, and an elongate flexible web substantially longer than the spacing between said upper and lower roller assemblies, each of said roller assemblies comprising an elongate tubular roller, bearing means engageable with the ends of each of said roller assemblies for rotatably journaling the ends of said roller with respect to said window opening, said web being scrolled onto and from said rollers as the latter are rotated about their respective longitudinal axes in one rotational direction or the other, and means for selectively driving each of said rollers in one rotational direction or the other so as to scroll and unscroll said web, said driving means comprising a gearmotor having an output shaft substantially coaxial with said gearmotor, said gearmotor being received within each said roller with said output shaft being substantially coaxial with said roller, said gearmotor being fixed against rotation relative to said frame, and means for maintaining said web taut as said web is scrolled and unscrolled from one of said rollers onto the other of said rollers and while said web is stationary, this last said means comprising a torsional spring operatively connecting said output shaft of a respective said gearmotor and a respective said roller, with one end of said torsional spring being fixed with respect to said roller and with the other end of said torsional spring being fixed with respect to said output shaft, one of said torsional springs operatively associated with one of said roller assemblies being wound in one direction, and the other of said torsional springs associated with the other of said roller assemblies being wound in the opposite direction.

2. Apparatus as set forth in claim 1 wherein said web has a plurality of regions thereon for variously absorbing, reflecting, or transmitting light therethrough.

3. Apparatus as set forth in claim 1 wherein said film has an opening therein which, when in register with said window opening, permits the passage of air therethrough, escape, or cleaning.

4. Apparatus as set forth in claim 1 wherein said gearmotor is of a diameter somewhat smaller than said roller such that said gearmotor is received coaxially within its respective said roller.

5. Apparatus as set forth in claim 4 wherein said bearing means comprises an inner race carried on the outer surface of said gearmotor, an outer race carried on the inner surface of said roller, and a plurality of roller bearing elements interposed between said races such that said roller is substantially coaxial with respect to said gearmotor.

6. Apparatus as set forth in claim 5 wherein said bearing means further comprises another rolling element bearing at the end of said roller opposite of said gearmotor.

7. Apparatus as set forth in claim 1 further comprising a shaft coupled to and rotatable with said gearmotor output shaft, said shaft extending at least partially lengthwise within said roller, a bushing carried by said shaft opposite said gearmotor rotatable within said roller for maintaining said shaft substantially centered within said roller, said bushing being slidable with respect to said roller, said spring being a torsional coil spring having a central opening therethrough disposed on the exterior of said shaft, one end of said spring being affixed to said shaft and the other end of said spring being affixed to said roller.

8. Apparatus as set forth in claim 1 wherein said film web is clear.

9. Apparatus as set forth in claim 1 wherein said film web is optically coated so as to provide segments thereon registerable with said window opening wth each segment having a desired coating thereon.

* * * * *